United States Patent [19]

Hudson

[11] 4,044,676

[45] Aug. 30, 1977

[54] PRINTING MECHANISM

[75] Inventor: William Ronald Hudson, Leigh, England

[73] Assignee: Milford-Astor Limited, England

[21] Appl. No.: 549,444

[22] Filed: Feb. 12, 1975

[30] Foreign Application Priority Data

May 6, 1974 United Kingdom ..... 5830/74

[51] Int. Cl.[2] ..... B41F 1/04

[52] U.S. Cl. ..... 101/297; 101/298; 101/27

[58] Field of Search ..... 101/27, 41–44, 101/297, 298, 287–295, 407 R, 407 BP, 407 A, 336

[56] References Cited

U.S. PATENT DOCUMENTS

| | | | |
|---|---|---|---|
| 425,826 | 4/1890 | Palmer | 101/298 X |
| 486,129 | 11/1892 | Scott | 101/294 X |
| 2,351,660 | 6/1944 | Campbell | 101/336 X |
| 2,819,671 | 1/1958 | Porter et al. | 101/44 |
| 3,120,175 | 2/1964 | Martin | 101/43 X |
| 3,584,573 | 6/1971 | Feplitz | 101/298 X |
| 3,636,866 | 1/1972 | Stommel et al. | 101/298 X |
| 3,765,326 | 10/1973 | Hawkins | 101/44 |
| 3,815,494 | 1/1973 | Bahnmuller | 101/27 X |
| 3,863,565 | 2/1975 | Patykula | 101/44 |
| 3,877,367 | 4/1975 | Norwood | 101/426 |

*Primary Examiner*—Edward M. Coven

[57] ABSTRACT

A printing mechanism comprises a housing, providing a print head carrying a flat type face, and a platen for supporting a forwardly moving sheet that is interposed between the platen and the type face. The platen includes an extended planar portion adjacent the sheet and movable parallel with it. Means are provided for bodily rotating the print head relative to the housing around an axis that is substantially parallel to the plane of the sheet, and in a path lying in a plane that is substantially perpendicular to the plane of the sheet so as to bring the type face into printing contact with the sheet against the platen planar portion; the planar portion is moved parallel with the sheet and at the same linear speed during the printing contact.

1 Claim, 9 Drawing Figures

PRINTING MECHANISM

This invention relates to printing mechanisms.

More particularly, it relates to printing mechanisms of the type that are preferably but not exclusively used for coding purposes. For example, such a device may be used to print packing data or the last date for sale or consumption of food on film material to be used for wrapping foodstuffs.

Such a coder is normally used in conjunction with a packaging machine using a continuously-moving sheet wrapping medium, which may be pre-printed or not. The coder may be part of the packaging machine or may be an independent unit. In the print operation, in general terms, a heat type face engages the moving wrapping sheet through a printing foil.

The sheet and foil must be supported during the printing contact of the type face and sheet. Since type face, sheet and foil are all moving during the printing contact, the support or platen must also be moved, and at the same linear speed as the other elements. In coders of the type hitherto known, a rotating cylindrical surface has been used for the platen. The area of contact between platen, sheet and type face is therefore necessarily narrow, which has limited the print operation to one of printing a single line.

It is desirable in many cases to be able to print more than a single line. It is an object of this invention, therefore, to provide a novel platen for use with a coder of the type described, that permits printing over a broad area rather than a single line, as disclosed in U.S. Pat. No. 3,023,698, for example.

According to the invention, a printing mechanism comprises a housing, providing a print head carrying a flat type face. The printing mechanism further comprises a platen for supporting a forwardly moving sheet that is interposed between the platen and the type face, and the platen includes an extended planar portion adjacent the sheet and movable parallel with it. Means are provided for bodily rotating the print head relative to the housing around an axis that is substantially parallel to the plane of the sheet, and in a path lying in a plane that is substantially perpendicular to the plane of the sheet so as to bring the type face into printing contact with the sheet against the platen planar portion; the planar portion is moved parallel with the sheet and at the same linear speed during the printing contact.

In preferred embodiments, the platen further includes a base fixed relative to the housing and providing bearing means; the planar portion is slidably mounted in the fixed base portion for motion parallel with the sheet between an initial position and a final position during the printing contact of the type face with the sheet. Biasing means are provided for returning the planar portion to the initial position after completion of the printing contact.

Other objects, features and advantages will appear from the following description of a preferred embodiment of the invention, taken together with the attached drawings thereof in which.

Figure 1:
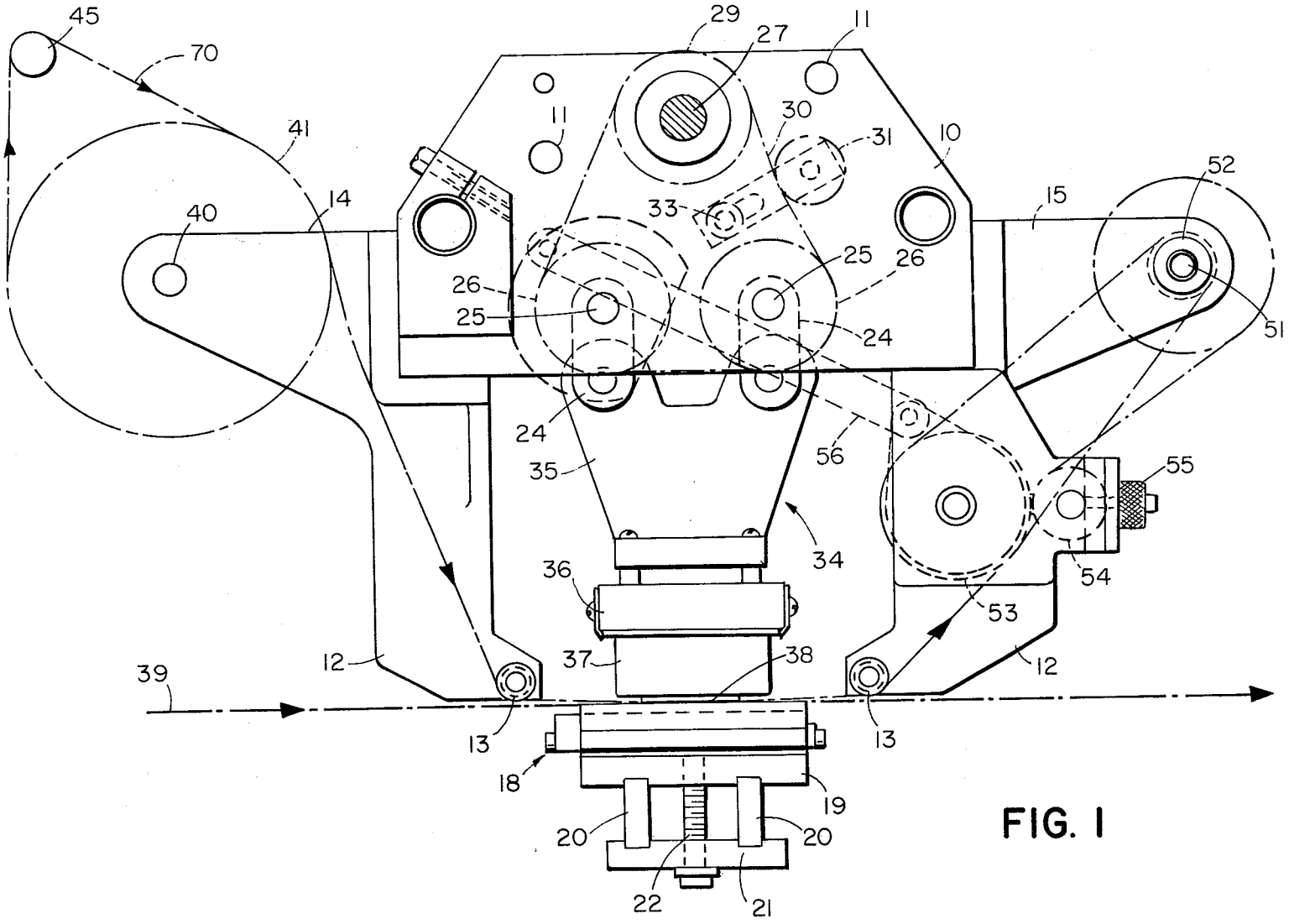
FIG. 1 is a side elevation of a printing mechanism according to the present invention.
Figure 9:
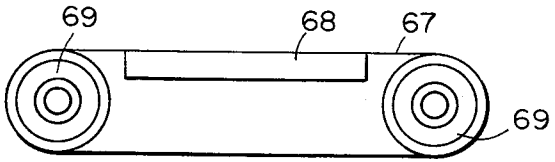
Figure 3:
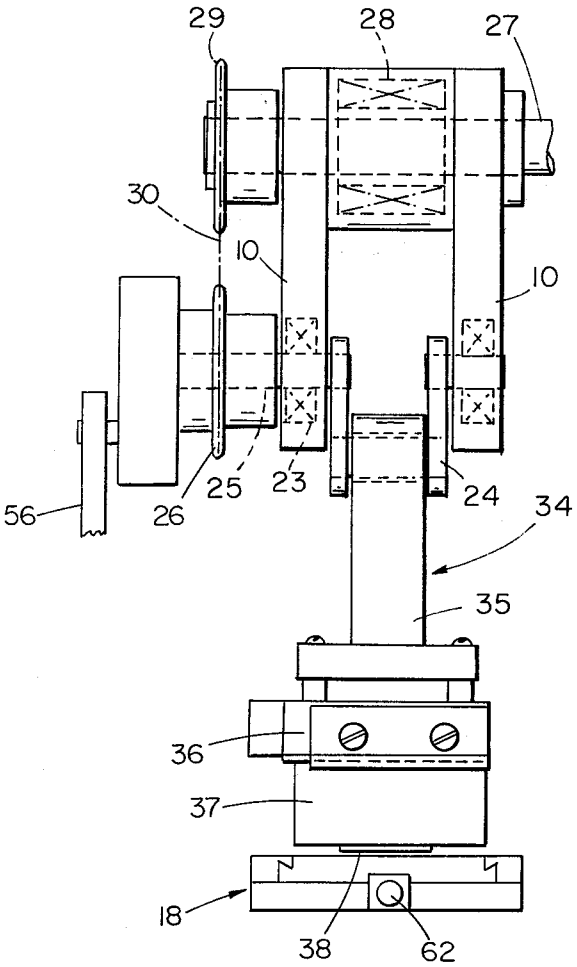
FIG. 3 is an end view of the printing mechanism see from the left in FIG. 1.

FIG. 9 is an alternative platen of the printing mechanism. Referring particularly to FIG. 1, the coder includes generally a printing foil that is intermittently fed from a supply reel 41 to a collection reel 52, and a movable printing head 34 mounting a flat type face which engages (through the foil) a moving sheet 39 supported on platen 18.

More particularly, the coder (see FIGS. 1 to 8) according to the invention comprises a housing defined by a pair of parallel fabrications or castings 10 interconnected by fixing screws 11, each fabrication or casting 10 having depending legs 12 interconnected by freely rotatable rollers 13. This housing is suitably mounted at the desired location on the packaging machine together with a base 18 to be described in greater detail later.

The material to be printed, for example, a sheet wrapping medium, is indicated by reference numeral 39 and its direction of movement in (FIG. 1) from left to right, the sheet 39 passing between the platen 18 and die box 37.

One of the castings 10 forming the housing has a horizontally extending arm 14 disposed at the supply reel end of the housing. The same fabrication or casting 10 has a horizontally-extending arm 15 at the opposite (collection reel) end of the housing.

Figure 4:
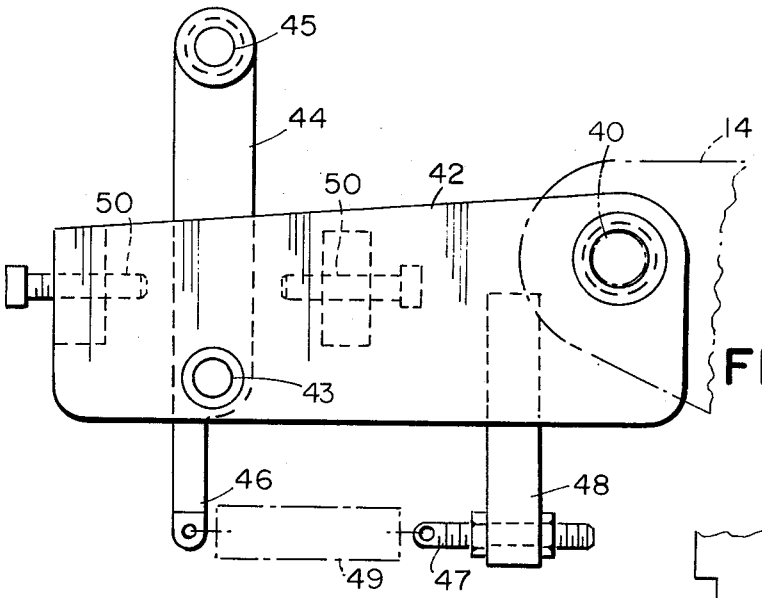
FIG. 4 is a detailed view to a larger scale of the supply reel end of the printing mechanism.
Figure 5:
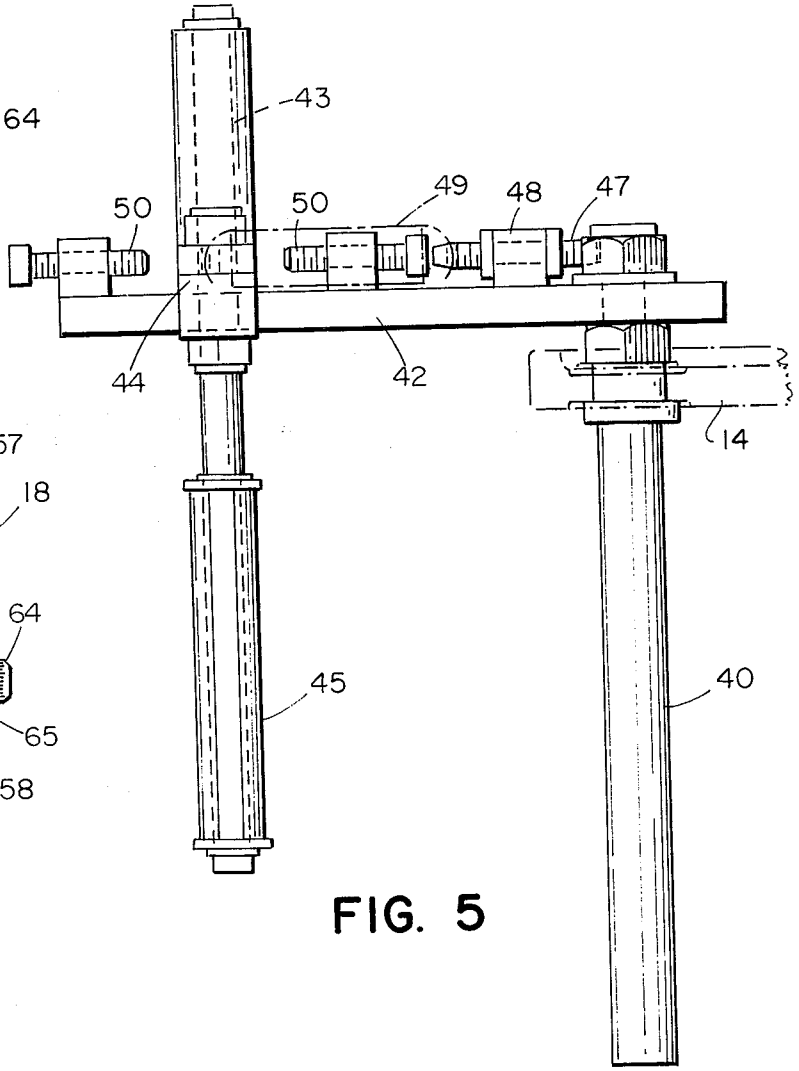
FIG. 5 is a plan view corresponding to FIG. 4.

Arm 14 mounts a spindle 40 on which can be detachably mounted a supply reel 41 of printing foil. In order to control the tension of the printing foil during its intermittent feed, arm 14 also mounts a horizontal bracket 42 (FIG. 4) on which pivots at 43 an arm 44 carrying a dancer roll 45. Arm 44 has a depending extension 46. A spring 49 is connected between extension 46 and a tension adjusting screw 47 engaging in an arm 48 of the bracket 42. Spring 49 maintains arm 44 substantially vertical. Adjustable screw stops 50 are mounted on bracket 42 with arm 44 between them to limit pivotal movement of arm 44 (FIGS. 4 and 5).

Arm 15 mounts a spindle 51 carrying a core 52 on which used printing foil is wound.

Figure 2:
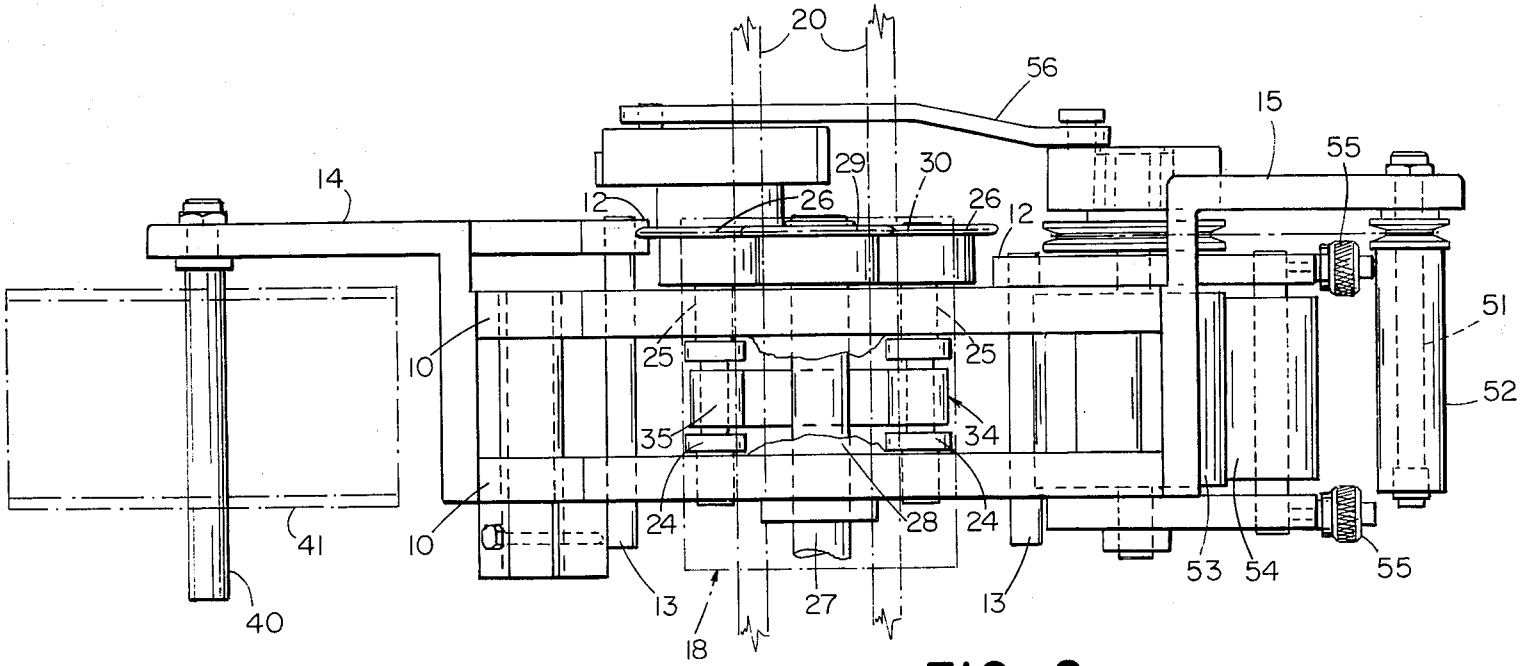
FIG. 2 is a plan view of the printing mechanism.

Between legs 12 of the body adjacent arm 15 there are mounted two rotatable uni-directional rollers 53 and 54 (FIGS. 1 and 2). Roller 54 is a pressure roller and is carried in bearings on which two screws 55 can act to adjust the pressure between rollers 53 and 54. Roller 53 incorporates a one-way indexing clutch (not shown).

The path of printing foil 70 from supply reel 41 to takeup core 52 is up and around the dancer roller 45, returning over the top of the reel 41, down and under the rollers 13 (above the film 39), up between rollers 53 and 54 and on to core 52.

Figure 8:
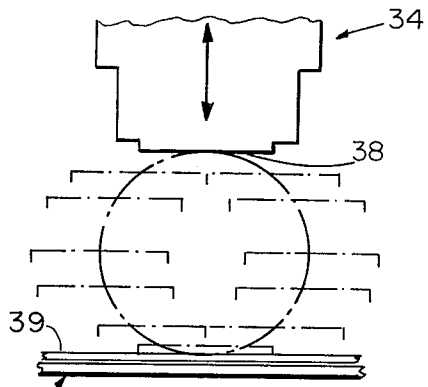
FIG. 8 is a diagrammatic representation of the movement of the print head.

Printing head 34 (FIG. 3) comprises a ram 35, a heater box 36 and a die box 37 with a flat type face 38 (FIG. 8). The printing head is moved relative to platen 18 by the following mechanism.

Each body fabrication or casting 10 has a pair of side-by-side bores in which are provided bearings 23. A pair of side-by-side U-shaped crank arms 24 are pivotally mounted in bearings 23. Each crank arm 24 has an axle 25 mounting a sprocket wheel 26. A link 56 connects roller 53 to one of the sprockets 26.

A shaft 27 supported in a bearing 28 traverses the body fabrications or castings 10 above the crank arms 24. Shaft 27 also mounts a sprocket wheel 29. The three sprocket wheels 26 and 29 are drivingly interconnected by an endless chain 30. A jockey wheel 31 carried by a slotted arm 32 engaged by a screw 33 in the body permits appropriate tensioning of the chain 30.

Shaft 27 is driven by an endless transmission (not shown) from the packaging machine at a predetermined rate.

The drive to shaft 27 may be effected in any convenient manner to achieve the desired result. For example, the control may be effected by photo-electric means or by cam-actuated micro-switch or proximity switch. A tacho-generator speed control may be used in conjunction with a motor and gearbox if desired. As a further alternative, a modulating drive may be employed to vary the timing between printing actions and consequently the frequency of printing.

Referring to FIG. 1, platen 18 is supported on a plate 19 lying on two transverse bars 20 connected to a plate 21 by a fixing screw 22.

Figure 7:
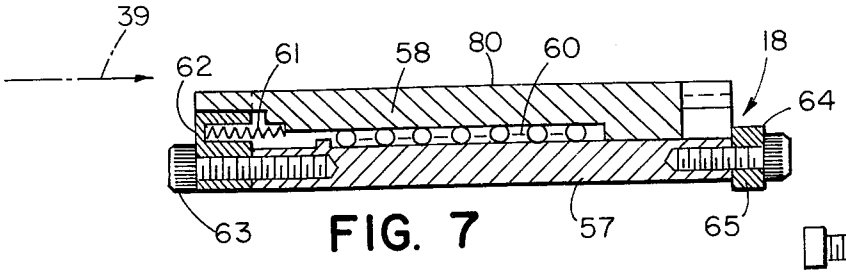
FIG. 7 is a sectional view of the reciprocating platen.
Figure 6:
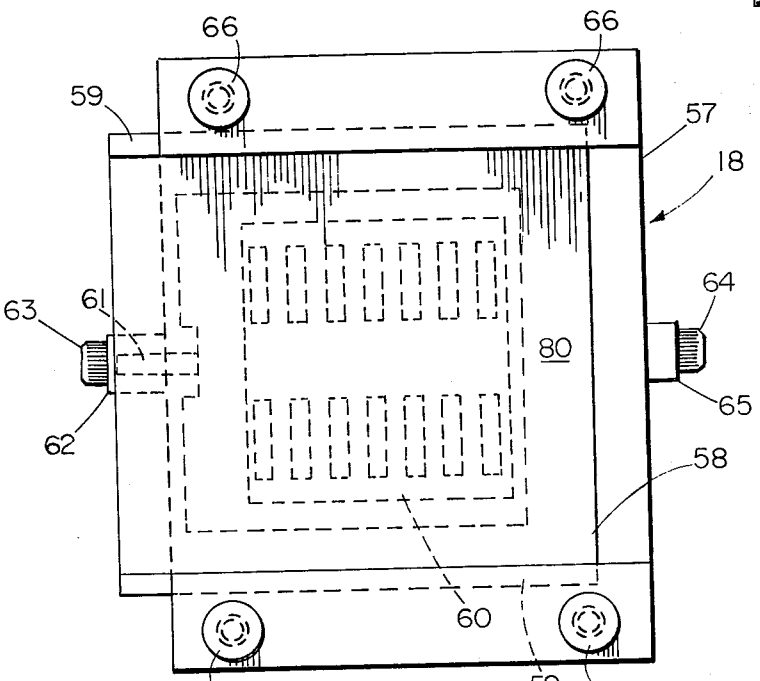
FIG. 6 is a plan view of the reciprocating platen of the printing mechanism.

Platen 18 (FIGS. 6 and 7) consists of a stationary base 57 and a movable upper part 58 retained within stationary base 57 by complementary dovetail lateral edges 59. Upper part 58 is slidable relative to base 57 over a roller bearing plate 60. Spring 61 is carried in a housing 62 connected to base 57 by a screw 63. Spring 61 biases movable part 58 to the left as seen in FIG. 7. A stop 65, secured to base 57 by a screw 64, limits rightward travel of movable part 58. Upper movable part 58 provides an extended planar portion that is adjacent sheet 39 and is movable (to the right in FIG. 7) parallel with the sheet during printing, under the action of printing head 34. Platen 18 is secured by bolts or screws 66 to plate 19.

An alternative platen is shown in FIG. 9, and comprises an endless belt 67 movable over a fixed stationary plate 68 and around suitable rollers 69, one of which may be driven. This structure also provides an extended planar portion that is adjacent sheet 39 and is movable parallel with the sheet during printing.

In operation, film 39 is fed continuously (by means not shown) between the platen 18 and the die box 37.

Rotation of shaft 27 drives the crank arms 24 to bodily rotate the print head 34 around an axis that is substantially parallel to the plane of the wrapping sheet, and in a path lying in a plane that is substantially perpendicular to the plane of the sheet (FIG. 8). Type face 38 remains horizontal (parallel with the sheet) at all times. Link 56, which connects roller 53 with one of sprockets 26, together with the one-way indexing clutch in roller 53, causes rollers 53 and 54 to rotate on the downward motion of print head 34, which advances foil 70 intermittently. Take up roll 51 is driven through a belt from roller 53.

The flat type face 38 is moved as described slo that at the instant of printing it is in parallel contact with and moving at the same linear speed as the film and foil. Type face 38 is in printing contact with sheet 39 when it engages the sheet, through film 70, and pinches it against the extended planar surface 80 of upper movable protion 58 of platen 18. At the instant of printing, the type face and the moving sheet are in parallel contact, or substantially so, and are moving at the same linear speed. At the same time upper portion 58 slides over roller plate 60, under the action of the printing head, in the same direction of movement as that of the film and foil. The extended planar surface of platen 18 thus provides an extended flat support for flat type face 38 throughout the printing contact, which prevents smudging of the print or severing of the foil or sheet. When printing head 34 lifts type face 38 out of printing contact with sheet 39, part 58 is returned by spring 61 to the initial position shown in FIGS. 6 and 7.

The printing mechanism that has been described is used for hot foil printing, and, in this case, a heater is associated with the flat type face which prints on the sheet through the intermediary of an indexed, intermittently-movable printing foil.

The mechanism may alternatively be used for ink printing, and in this case an inking mechanism would be provided.

It may also be used for blind coding and in this case the flat type face, whether heated or not, acts directly on the sheet.

What is claimed is:

1. Printing mechanism comprising a housing print head support means including a print head carrying a flat type of face movably mounted on said housing a platen comprising a freely movable endless conveyor for supporting a sheet to be printed, said sheet moving forwardly with respect to said printing mechanism and being interposed between said platen and said type face said platen being mounted on said housing and including a base fixed with respect to said housing and an extended planar portion adjacent said sheet and movable with respect to said housing, by pressure contact of said type face against said sheet, in a plane parallel with said sheet and in the direction of movement of said sheet, through a limited distance between a type face initial contact position and a type face release position, said print head support means bodily moving said printing head relative to said housing along a path defining a closed curve around an axis that is substantially parallel to the plane of the sheet and platen, said path lying in a plane that is substantially perpendiuclar to the plane of the sheet and platen so as to bring said type face into printing contact with said sheet against said platen movable planar portion, said type face pinching said sheet against said planar portion, said type face and said sheet moving parallel during said printing contact and providing the sole driving force to move said platen therewith, said platen planar portion being thereby moved parallel with said sheet and at the same linear speed and in the same direction as said sheet from said type face initial contact position to said type face release position during said printing contact.

* * * * *